US008105225B2

(12) United States Patent
Ausnit

(10) Patent No.: US 8,105,225 B2
(45) Date of Patent: Jan. 31, 2012

(54) PROCESS AND APPARATUS FOR FORMING PACKAGING BAGS WITH A FASTENER

(75) Inventor: Steven Ausnit, New York, NY (US)

(73) Assignee: Illinois Tool Works Inc., Glenview, IL (US)

( * ) Notice: Subject to any disclaimer, the term of this patent is extended or adjusted under 35 U.S.C. 154(b) by 975 days.

(21) Appl. No.: 11/451,793

(22) Filed: Jun. 13, 2006

(65) Prior Publication Data

US 2006/0228056 A1 Oct. 12, 2006

Related U.S. Application Data

(60) Division of application No. 10/945,313, filed on Sep. 20, 2004, now Pat. No. 7,059,099, which is a division of application No. 10/167,809, filed on Jun. 12, 2002, now Pat. No. 6,820,395, which is a continuation-in-part of application No. 09/633,944, filed on Aug. 8, 2000, now Pat. No. 6,694,704, which is a division of application No. 09/292,256, filed on Apr. 15, 1999, now abandoned.

(30) Foreign Application Priority Data

Apr. 20, 1998 (FR) ..... 98 04913
May 19, 1998 (FR) ..... 98 06292

(51) Int. Cl.
*B31B 1/90* (2006.01)

(52) U.S. Cl. ..... 493/213; 493/212; 493/214

(58) Field of Classification Search ..... 53/133.4, 53/139.2, 412, 450, 545; 493/213, 214, 927
See application file for complete search history.

(56) References Cited

U.S. PATENT DOCUMENTS

| | | | | |
|---|---|---|---|---|
| 4,925,316 | A * | 5/1990 | Van Erden et al. | 383/210.1 |
| 5,893,645 | A * | 4/1999 | May | 383/210.1 |
| 6,131,369 | A * | 10/2000 | Ausnit | 53/412 |
| 6,212,857 | B1 * | 4/2001 | Van Erden | 53/412 |
| 6,290,390 | B1 * | 9/2001 | Buchman | 383/64 |
| 6,354,738 | B1 * | 3/2002 | Buckman et al. | 383/64 |
| 6,474,866 | B2 * | 11/2002 | Buchman | 53/412 |
| 6,488,410 | B2 * | 12/2002 | Schneider | 53/412 |
| 6,527,444 | B1 * | 3/2003 | Buchman | 53/412 |
| 6,588,176 | B1 * | 7/2003 | Buchman | 53/412 |
| 6,769,229 | B2 * | 8/2004 | Kinigakis et al. | 53/412 |
| 6,820,393 | B2 * | 11/2004 | Kinigakis et al. | 53/412 |
| 6,830,377 | B2 * | 12/2004 | Schneider | 383/64 |
| 6,880,973 | B2 * | 4/2005 | Schneider et al. | 383/64 |
| 6,901,637 | B2 * | 6/2005 | Machacek | 383/64 |
| 2003/0022778 | A1 * | 1/2003 | Schneider | 53/412 |
| 2003/0041563 | A1 * | 3/2003 | Schneider et al. | 53/412 |
| 2003/0223652 | A1 * | 12/2003 | Schneider | 383/64 |

* cited by examiner

*Primary Examiner* — Christopher Harmon
(74) *Attorney, Agent, or Firm* — Day Pitney LLP

(57) ABSTRACT

A process for manufacturing reclosable bags (30) by forming a film (50) includes moving the film (50) and attaching to the film (50) sequentially and crosswise with reference to the direction of movement of the film (50), a fastener (1) including a first strip (2) supporting at least one reclosable profile (10) engaged with another reclosable profile (12) that is complementary thereto and supported by a second strip (4) or a part of the first strip (2), which will subsequently be attached to the film (50). Each strip (2, 4) includes at least one web (6, 8) extending substantially mostly sideways on one side of the profiles (12). The above arrangements make possible special fasteners (1) that include sliders (9), gasket membranes (26), fasteners inverted within the bag (30), peel seals (18, 20, 21) and hinged fasteners (1).

1 Claim, 19 Drawing Sheets

FIG. 1A
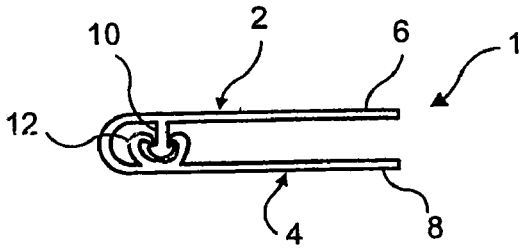
FIG. 1B
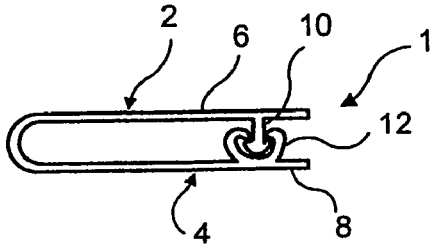
FIG. 1C
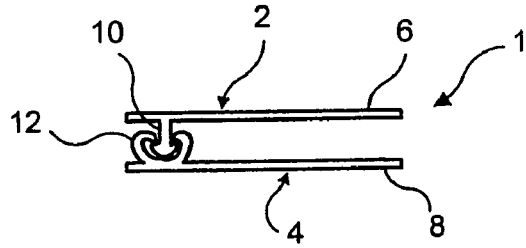
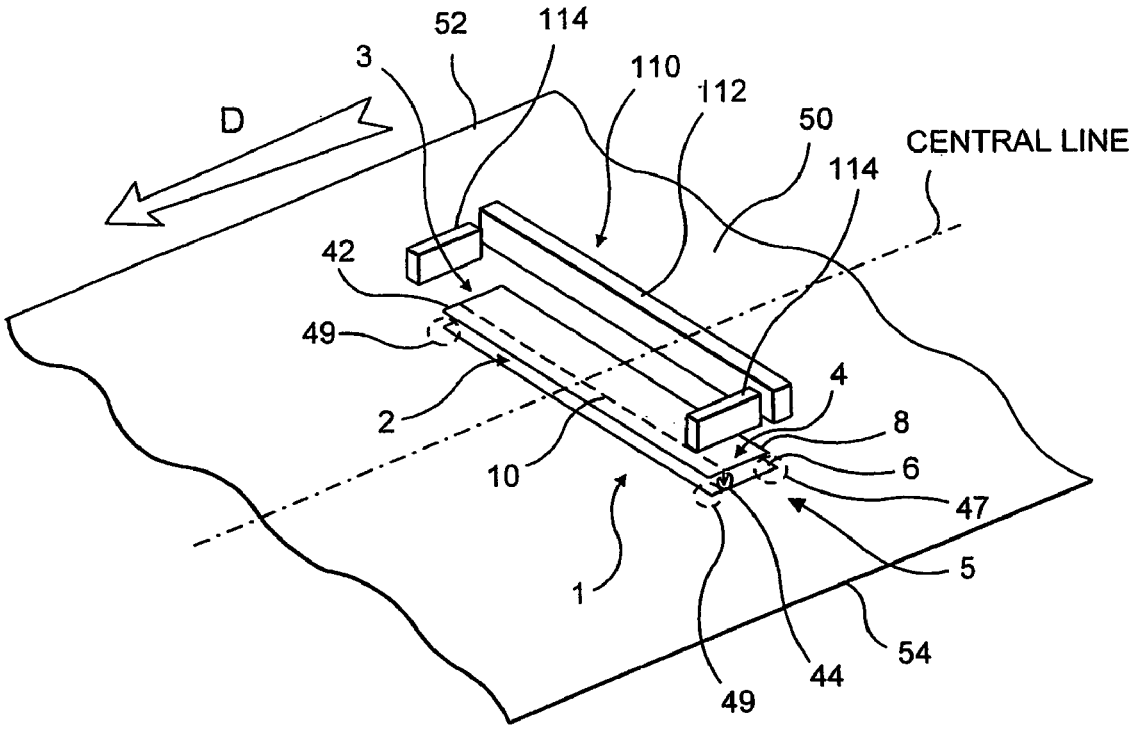
FIG. 2

PROCESS AND APPARATUS FOR FORMING PACKAGING BAGS WITH A FASTENER

RELATED APPLICATION

This application is a divisional of U.S. application Ser. No. 10/945,313, filed Sep. 20, 2004, now U.S. Pat. No. 7,059,099, which is a divisional of U.S. application Ser. No. 10/167,809, filed on Jun. 12, 2002, now U.S. Pat. No. 6,820,395, which is a continuation-in-part of U.S. application Ser. No. 09/633,944 filed on Aug. 8, 2000, now U.S. Pat. No. 6,694,704, which is a division of U.S. application Ser. No. 09/292,256, filed on Apr. 15, 1999, which claims priority under 35U.S.C. §119 of French patent application 98 04913 filed Apr. 20, 1998, French patent application 98 06292 filed May 19, 1998.

BACKGROUND OF THE INVENTION

1. Field of the Invention

This invention relates to automatic package forming, filling and sealing machines involving fasteners, for example, with complementary male and female profiles. Specifically, a package is formed by moving a length of thermoplastic film and attaching to the film sequentially and crosswise with reference to the direction of movement of the film, a fastener including a first strip supporting one reclosable profile engaged with another reclosable profile that is complementary thereto and supported by a second strip or a part of the first strip, which will subsequently be attached to the film.

2. Description of the Prior Art

U.S. Pat. No. 4,909,017 to McMahon et al. describes a process in which bags are provided with a fastener when they are formed on a forming, filling and sealing (FFS) machine. The bags are formed from a film of thermoplastic material. The film is in the form of a strip of material extending between two free edges that are longitudinal with reference to the movement of the film. This film is unrolled upstream of a filling tube. The fastener is positioned on the film, also upstream of the filling tube and transversely with respect to the direction of movement of the film. The fastener comprises two strips provided with complementary profiles. A first strip of the fastener is welded to the film upstream of the tube, on a portion of the film which is intended to form a first bag wall. The bag is then formed by enveloping the tube and welding the two longitudinal edges of the film. The second fastener is then welded below the tube to a second bag wall.

U.S. Pat. No. 4,655,862 to Christoff et al. also describes a process for forming reclosable bags on FFS machines, in which bags are provided with a fastener positioned at right angles to the direction of formation of these bags. This fastener is placed below the filling tube on a film in the form of a single strip. This strip includes at least one fold zone crosswise to the strip so that the strip can be folded back on itself, and areas of the strip that can work together to seal the bag can be brought opposite one another.

It is therefore an object of the present invention to make the steps involving the support, welding and installation of the fastener on the film easier to perform than in the processes described in the above-cited references.

SUMMARY OF THE INVENTION

The above and other beneficial objects of the present invention are attained by providing a process for the fabrication of a film material intended to form the bags, including steps of moving the film and fixing fasteners sequentially on the film and transversely with reference to the direction of movement of the film. The fastener comprises a first strip supporting at least one reclosable profile in engagement with another reclosable profile, which is complementary thereto and is supported by a second strip or a part of the first strip. The second strip or the part of the first strip that supports the other profile will be subsequently fixed to the film. Each strip has at least one web extending laterally on one side of the profile or profiles supported thereby.

These webs give the invention a number of advantages. Because of its larger cross-section, a fastener for implementing the process according to the invention is easily moved and positioned. In addition, the webs can be attached at sufficiently low temperatures to prevent damaging the profiles.

It is also possible for the step of attaching the fastener to the film to be performed by sealing the film with at least one area of these webs different from the area located under the profiles to prevent damage to the profiles during the attaching step.

BRIEF DESCRIPTION OF THE DRAWINGS

The above and other aspects, purposes and advantages of the invention will be apparent from the following detailed description. The invention will also be more fully understood when read in conjunction with the accompanying drawings, in which:

FIG. 1A is a cross-sectional view of a first fastener for embodying the process according to the invention;

FIG. 1B is a cross-sectional view of a second fastener for embodying the process according to the invention;

FIG. 1C is a cross-sectional view of a third fastener for embodying the process according to the invention;

FIG. 2 is a perspective view of a fastener and means for welding the fastener onto a film intended to form reclosable bags using the process according to the invention;

DETAILED DESCRIPTION OF THE PREFERRED EMBODIMENTS

Figure 1D:
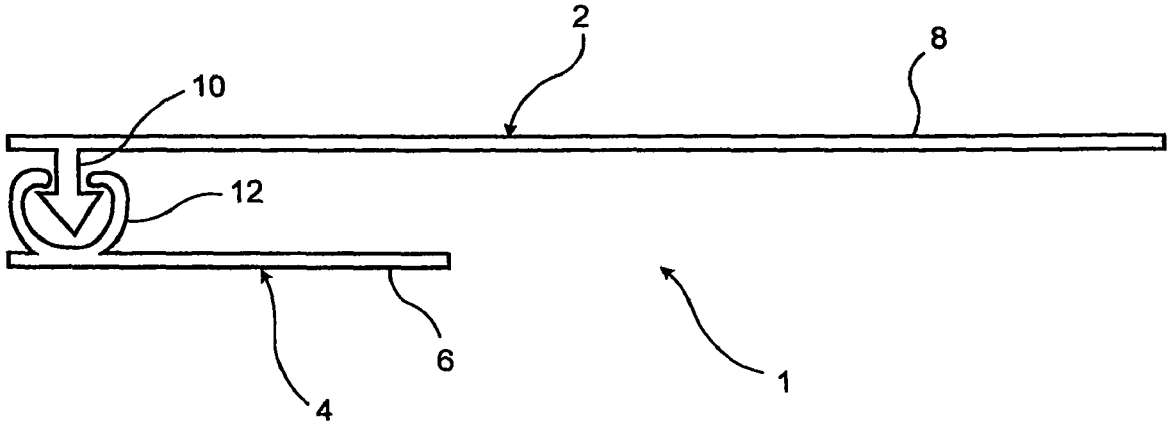
FIG. 1D is a cross-sectional view of a fourth fastener for embodying the process according to the invention.

Referring now to the drawings in detail wherein like numerals indicate like elements throughout the several views, FIG. 1 shows five types of fasteners 1 for embodying the process according to the invention.

These fasteners include two strips 2, 4. As shown in the figure, the strips 2, 4 respectively include webs 6, 8 and fastener profiles 10, 12. Profiles 10, 12 extend on the strips 2, 4 in the longitudinal direction thereof. Profiles 10, 12 have forms capable of interlocking in a complementary manner. For example, one of the profiles 10, known as the male profile, has the shape of an arrowhead in cross-section. Profile 10 can be introduced and kept engaged in profile 12, known as the female profile, which is in the form of a groove. Each strip 2, 4 can have a number of profiles 10, 12 similar, for example, to those described above. These profiles 10, 12 are then parallel to each other. Strips 2, 4 respectively include a first web 6 and a second web 8, which extend substantially laterally on one side of the profiles 10, 12.

According to certain variants of the invention, the first web 6 and the second web 8 can be replaced by a first part 6 and a second part 8 of a single web that makes it possible to join the two strips 2, 4.

Figure 1E:
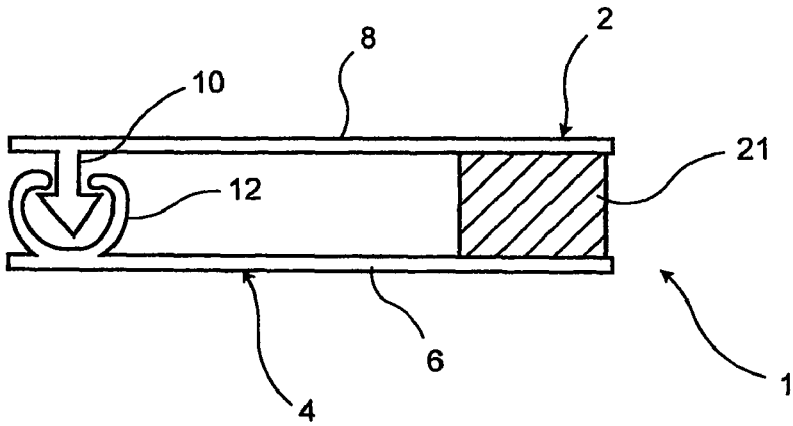
FIG. 1E is a cross-sectional view of a fifth fastener for embodying the process according to the invention.

The fasteners shown in FIGS. 1A and 1B include two complementary profiles 10, 12. Each profile 10, 12 is supported by one of the two parts 6, 8 of a single web which has a U-shaped cross-section with respect to the longitudinal direction of profiles 10, 12. Profiles 10, 12 of the fastener 1 shown in FIG. 1A are close to the bottom of the U-shaped cross-section. Profiles 10, 12 of the fastener 1 shown in FIGS. 1B-1E are close to the free ends of the U-shaped cross-section, thereby allowing placement of an opening slider, as will be discussed below. Webs 6, 8 of the fastener 1 shown in FIGS. 1C-1E are independent of each other.

These fasteners 1 are particularly adapted to be attached to the film 50 by the process according to the invention, since the surface of the webs 6, 8 permits welding onto the film 50 on an area of the webs not under profiles 10, 12. This facilitates placement of the fastener 1 and welding the same to the film 50. Preferably, at least one web 6, 8 extends sideways onto an area at least equal in surface area to the area located under profiles 10, 12. Preferably, the process according to the invention is used to form reclosable bags 30 on an FFS machine 100, shown in FIG. 3.

In this case, during the process according to the invention, the step of attaching the first web to a film 50 is executed upstream of a filling tube 130 of the FFS machine 100. The film 50 moves toward the tube 130 in the direction indicated by arrow D. The film 50 has two free longitudinal edges 52, 54 parallel to its direction of movement.

A fastener 1 is brought crosswise with respect to the direction D of the movement of the film 50. As shown in FIG. 2, the fastener 1 is oriented toward the film 50 so that the longitudinal direction of profiles 10, 12 is perpendicular to the longitudinal edges 52, 54 of the film 50. Fastener 1 can be any one of the five fasteners 1 shown in FIG. 1 or may be any other fastener 1, including those shown hereinbelow, adapted for implementation of the process according to the invention.

Preferably, the length of the fastener 1 is approximately equal to half the size of the film 50 with respect to the direction of movement D thereof. The fastener 1 may be placed near one of the longitudinal edges 52, 54 of the film 50. Preferably, the fastener 1 is attached approximately centered with respect to the two longitudinal edges 52, 54. The fastener 1 is guided, pulled or pushed by roller-equipped means and/or by a two-way mechanism so that it is properly positioned on the surface of the film 50. The fastener 1 is positioned on a portion of the film 50 suitable for forming a first bag wall so that one of the two strips 2, 4 is placed flat on one face of the film 50. The strip 2 with the first web 6 rests on the surface of the film 50. Prior to being positioned on the film 50, fastener 1 is advantageously provided with two spot welds 42, 44. Each spot weld 42, 44 is situated at one longitudinal end 3, 5 of the strips 2, 4 and, more particularly, at the location of profiles 10, 12, and thus helps ensure that the fastener 1 is watertight at the longitudinal ends of the profiles 10, 12.

Fastener 1 is placed on the film 50 under first transversal welding means 110. These first transversal welding means 110, for example, include a welding bar 112 that is crosswise with respect to the direction of movement D of the film 50, and two welding bars 114 that are longitudinal with respect to the direction of movement D of the film 50. The length of the welding bar 112 is approximately equal to that of fastener 1. The two welding bars 114 are located at the ends of the welding bar 112, at right angles thereto, and the welding bars 114 are approximately equal in length to the width of fastener 1. The welding bars 112, 114 are lowered and pressed onto the edge of webs 6, 8, either together or independently of each other.

Thus, according to one variant of the process, the step of attaching the first web 6 to the film 50 is performed only at the longitudinal ends 3, 5 of the strips 2, 4 by the longitudinal welding bars 114. According to another variant of the process, the first web 6 is attached to the film 50 through the welding bar 112 only on the edge of the web 6 which will be toward the outside of the reclosable bag 30 with respect to profiles 10, 12 when the reclosable bag 30 is formed. According to still another variant of the process, the first web 6 is attached upstream of the tube 130 by combining the two preceding variants.

According to still another variant of the process, the second web 8 of the fastener, shown in FIG. 1D, is attached to the film 50 through the welding bar 112. The second web is preferably attached by a peel seal 11 on the edge of the web 6 which will be toward the inside of the reclosable bag 30 with respect to profiles 10, 12 when the reclosable bag 30 is formed. (See FIG. 27) According to still another variant of the process, the second web 8 is attached upstream of the tube 130 by combining the two preceding variants for the first web 6 at an earlier sealing point when the film is moved in direction D.

Figure 21:
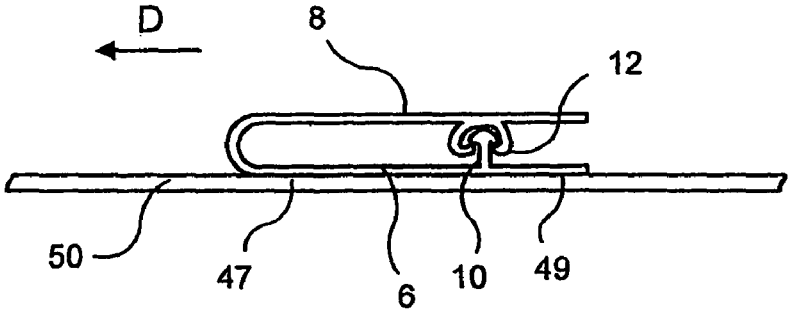
FIG. 21 is a cross-sectional view of a variant of the attachment of a fastener on a film.

Alternatively, for certain fasteners 1 the first web 6 is attached at no less than two points 47, 49 situated on either side of the profile 10 supported by the first web 6 with respect to the longitudinal direction. The first web 6 is thus attached as part of the film 50 at a given point toward the front and at a point located to the rear with respect to the direction of movement D. This makes it possible to prevent fastener 1 from being turned around during the formation of the reclosable bag 30 on the tube 130 (FIGS. 2 and 21). A machine according to the invention can also allow implementation of this variant of the process.

Alternatively, the fastener 1 can be attached to the film 50 prior to forming the reclosable bag 30 at the same time the spot welds 42, 44 are being made. In this case, the fastener 1 is moved on the film 50 even if the spot welds 42, 44 have not been made. Then, once the fastener 1 is in place, appropriate longitudinal welding bars 114 weld the longitudinal ends 3, 5 of strips 2, 4 in the same operation that makes the weld points 42, 44.

Figure 3:
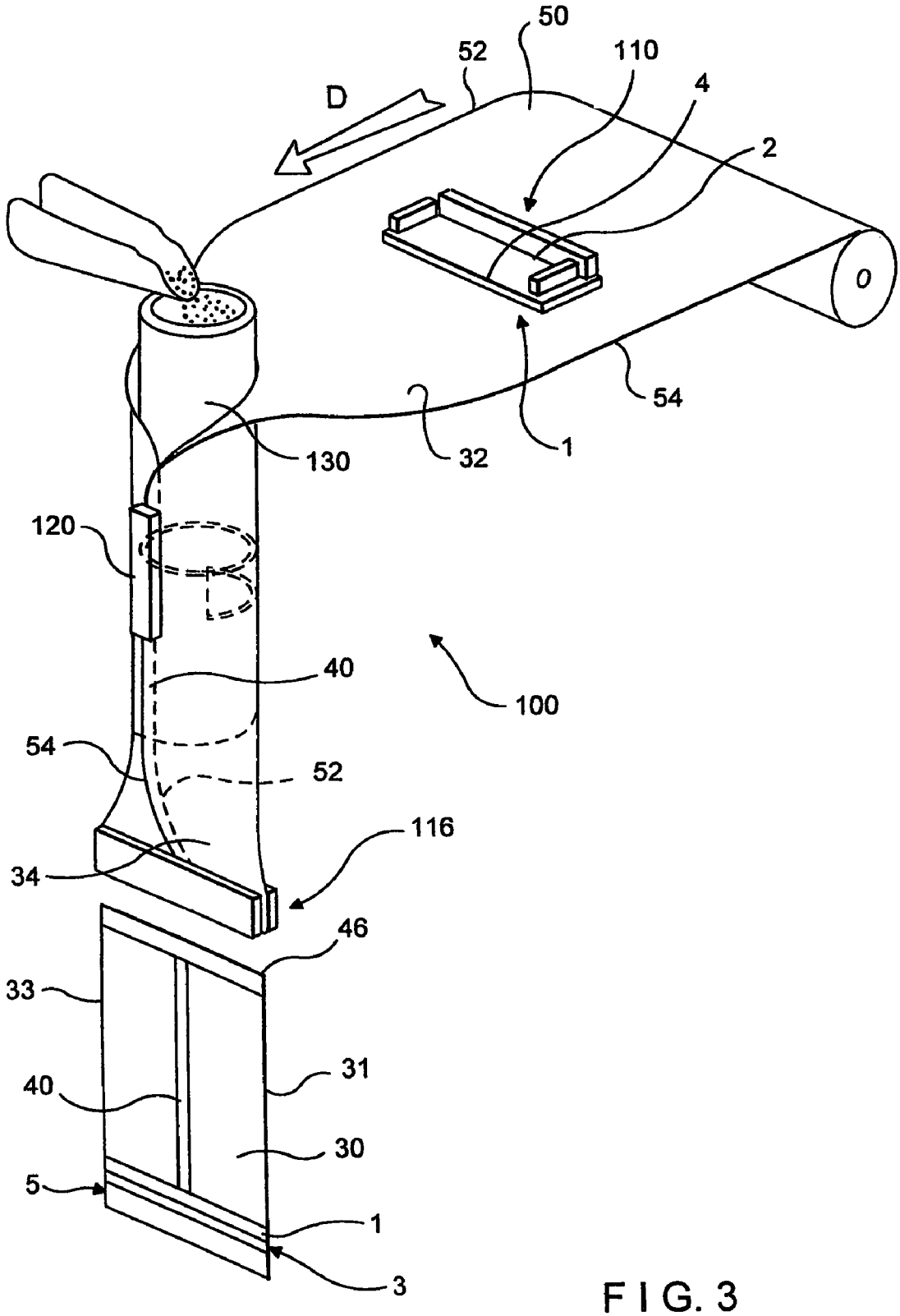
FIG. 3 is a perspective view of first and second means for welding the fastener located upstream and downstream, respectively, of a filling tube of a bag forming machine according to the invention.

FIG. 3 shows the formation of the reclosable bag 30 from the film 50 around the tube 130. The film 50 with the fastener 1 is conveyed toward the tube 130. The film 50 is then wrapped around tube 130. The free longitudinal edges 52,54 are positioned one over the other parallel to the axis of the tube 130 to be welded to one another by longitudinal welding means 120, which is capable of forming a longitudinal weld seam 40. By folding the film 50 longitudinally with respect to its direction of movement, a second wall 34 of the reclosable bag 30 is formed.

The reclosable bag 30 has two longitudinal folds 31, 33 and an opening that is closed by fastener 1. The reclosable bag 30 is hennetically sealed by the longitudinal weld 40 and one transversal weld 46. The transversal weld 46 extends between the longitudinal folds 31, 33 and is located on the edge of the walls 32, 34 longitudinally opposed to the fastener 1.

Figure 4:
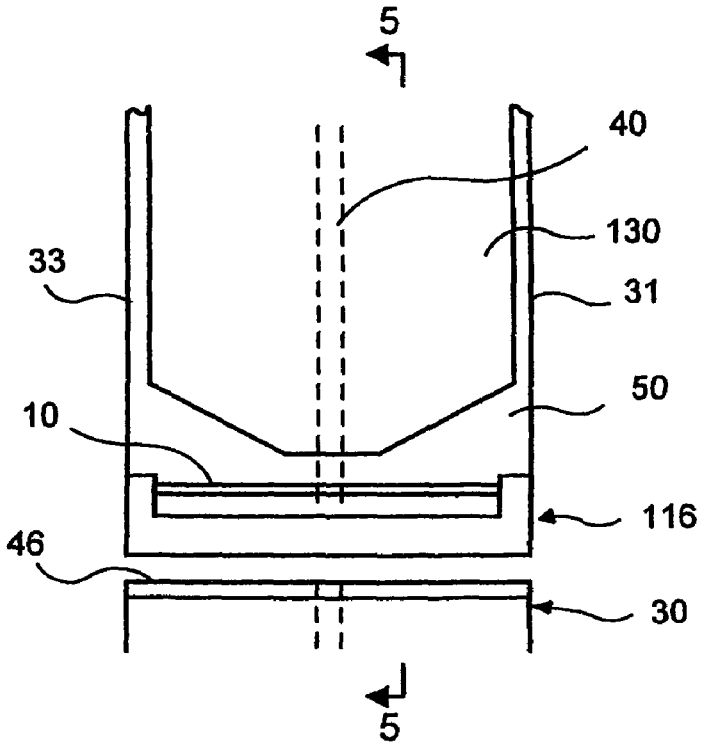
FIG. 4 is a top plan view of the second welding means of the bag forming machine.

FIG. 4 shows second transversal welding means 116. The second transversal welding means 116 is adapted to attach the second web 8 of the fastener 1 to the second wall 34 of the reclosable bag 30 below the tube 130.

Figure 5:
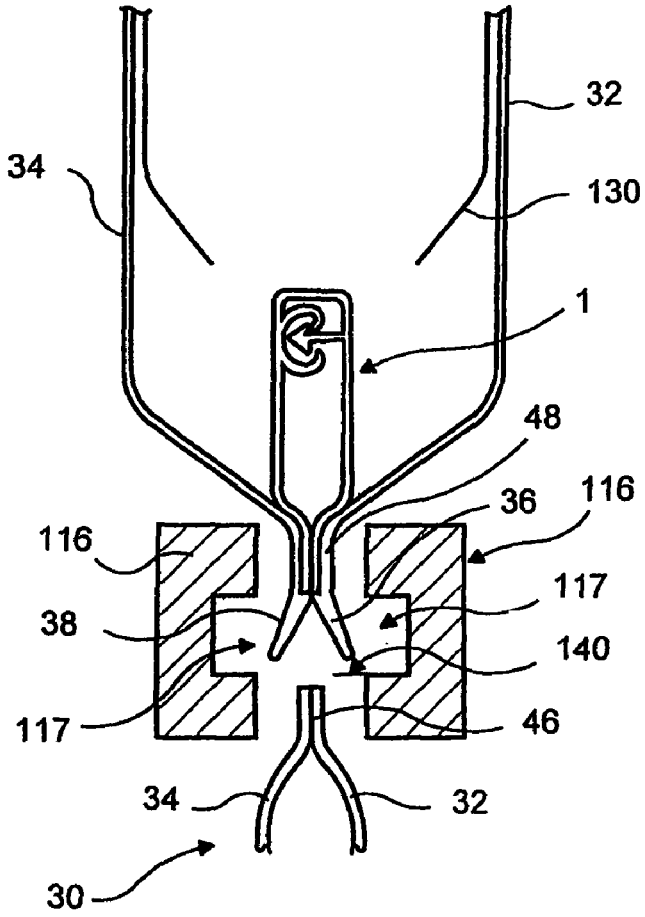
FIG. 5 is a cross-sectional view of the filling tube and the second welding means taken along line 5-5 of the bag forming machine shown in FIG. 4.

As shown in FIG. 5, the second transversal welding means 116 simultaneously makes it possible to weld the fastener 1 to the walls 32, 34 and to form the transversal weld 46. Preferably, cutting means 140 are solidly joined to second transversal welding means 116 in order to cut successive bags 30. The cutting means 140 can form a cut that is crosswise to the direction of movement of the film 50.

Preferably, the second transversal welding means 116 also includes grooves 117, which extend over the entire length of the second transversal welding means 116. The grooves 117 of each of the second welding means 116 are facing one another and are turned toward each another to form a cavity. These grooves 117 make it possible to avoid welding the walls 32, 34 in a small transversal area downstream of the fastener 1. This transversal area makes it possible to form tongues 36, 38 that allow the walls 32, 34 to be grasped to spread the walls apart and to open the reclosable bag 30. Alternatively, the formed tongues 36, 38 may be sealed at a peel seal 57 to provide a protective film around the fastener 1 and the attached slider 9, as shown in FIGS. 27-27D and described below.

Figure 3A:
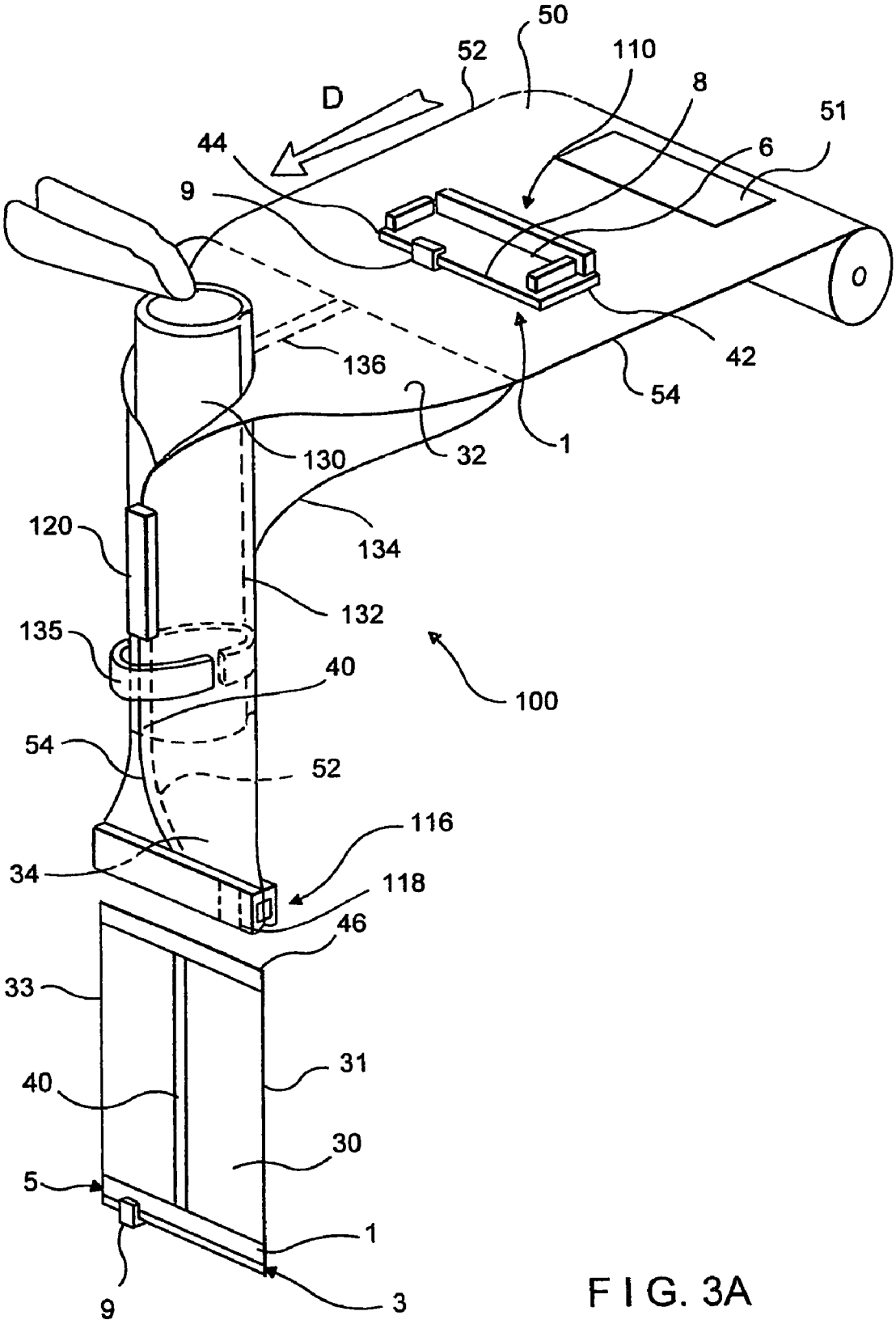
FIG. 3A is a perspective view of a variant of the bag forming machine that is adapted for fixing fasteners which include a slider.

A number of additional variants of the fastener 1 for implementing the process according to the invention will be described hereinbelow. According to one of these variants, the fastener 1 includes the slider 9. The slider 9 can be of any known type capable of engaging the profiles 10, 12 when moved in a first direction and disengaging the profiles 10, 12 when moved in a second direction opposite the first direction. The process of making film 50 must be adapted to attach fasteners 1 with the slider 9. In one variant, as shown in FIG. 3A, the process includes a step of positioning film 50, which include a first cutout 51, before the tube 130. The first cutout 51 permits access to the slider 9 over the entire length of the profiles 10, 12. For example, the form and dimensions of the first cutout 51 are slightly smaller than those of the fastener 1. The first cutout 51 is spaced apart on the film 50 by a distance equal to the dimension of the reclosable bag 30 in the direction parallel to movement D of the film 50. The process then includes a step of positioning fastener 1 on the first cutout 51 before the filling tube 130.

Figure 27:
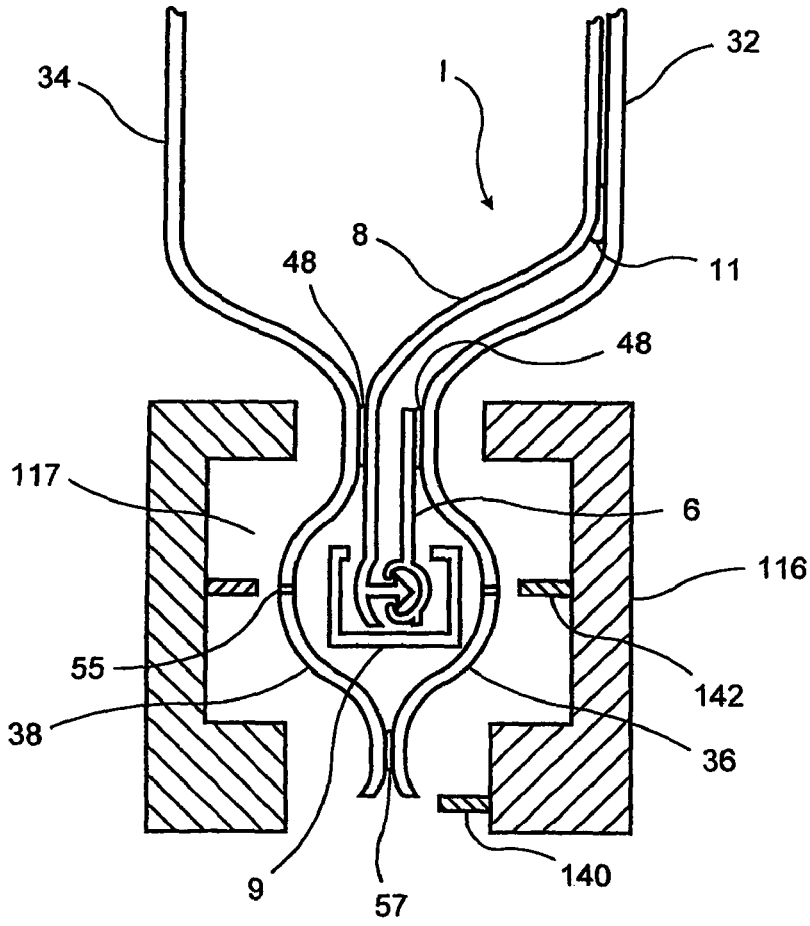
FIG. 27 is a cross-sectional view that is crosswise to the length of the fastener shown in FIG. 1D taken along line 27-27 of FIG. 26.
Figure 27A:
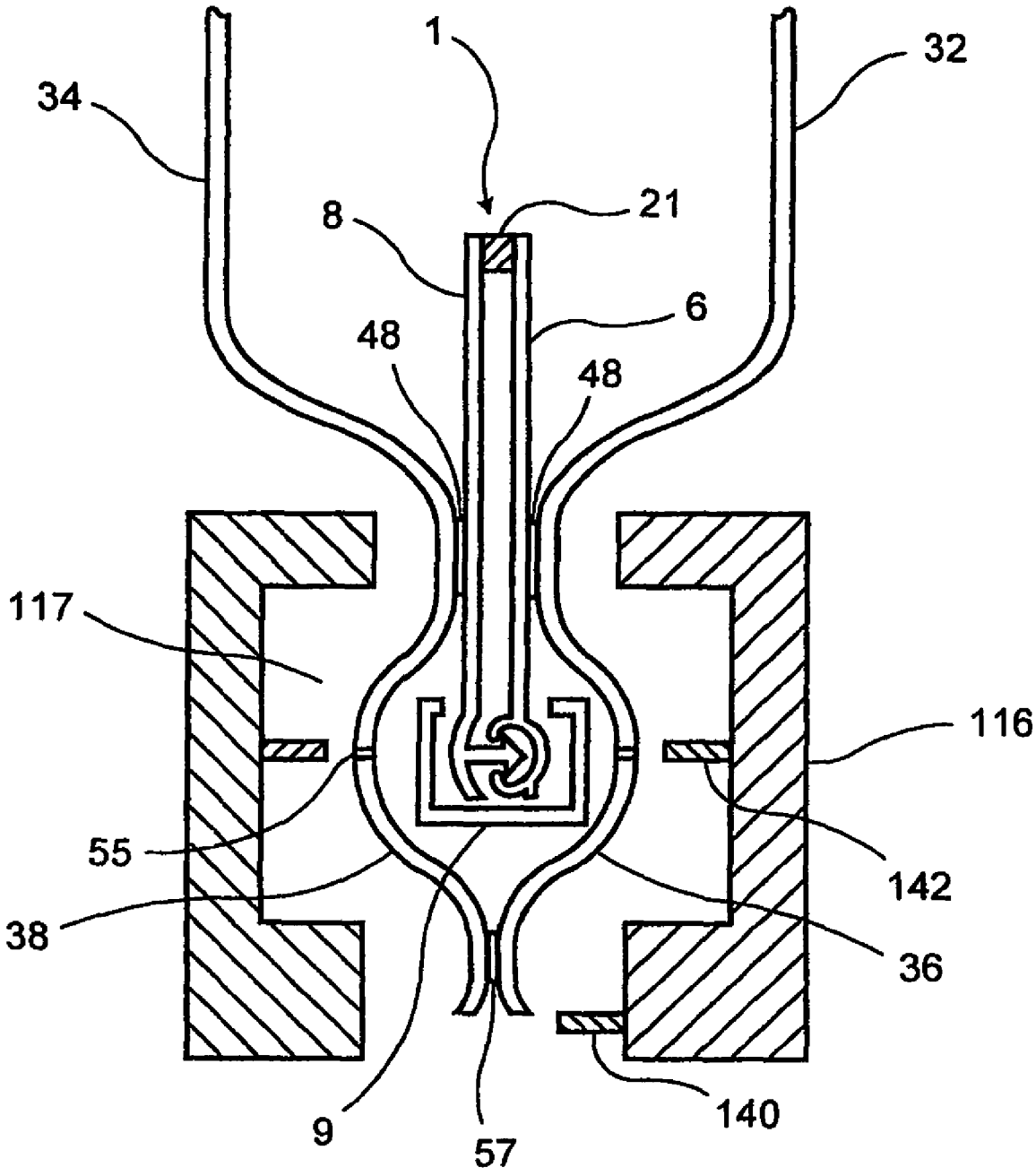
FIG. 27A is a cross-sectional view that is crosswise to the length of the fastener shown in FIG. 1E taken along line 27A-27A of FIG. 26.
Figure 27B:
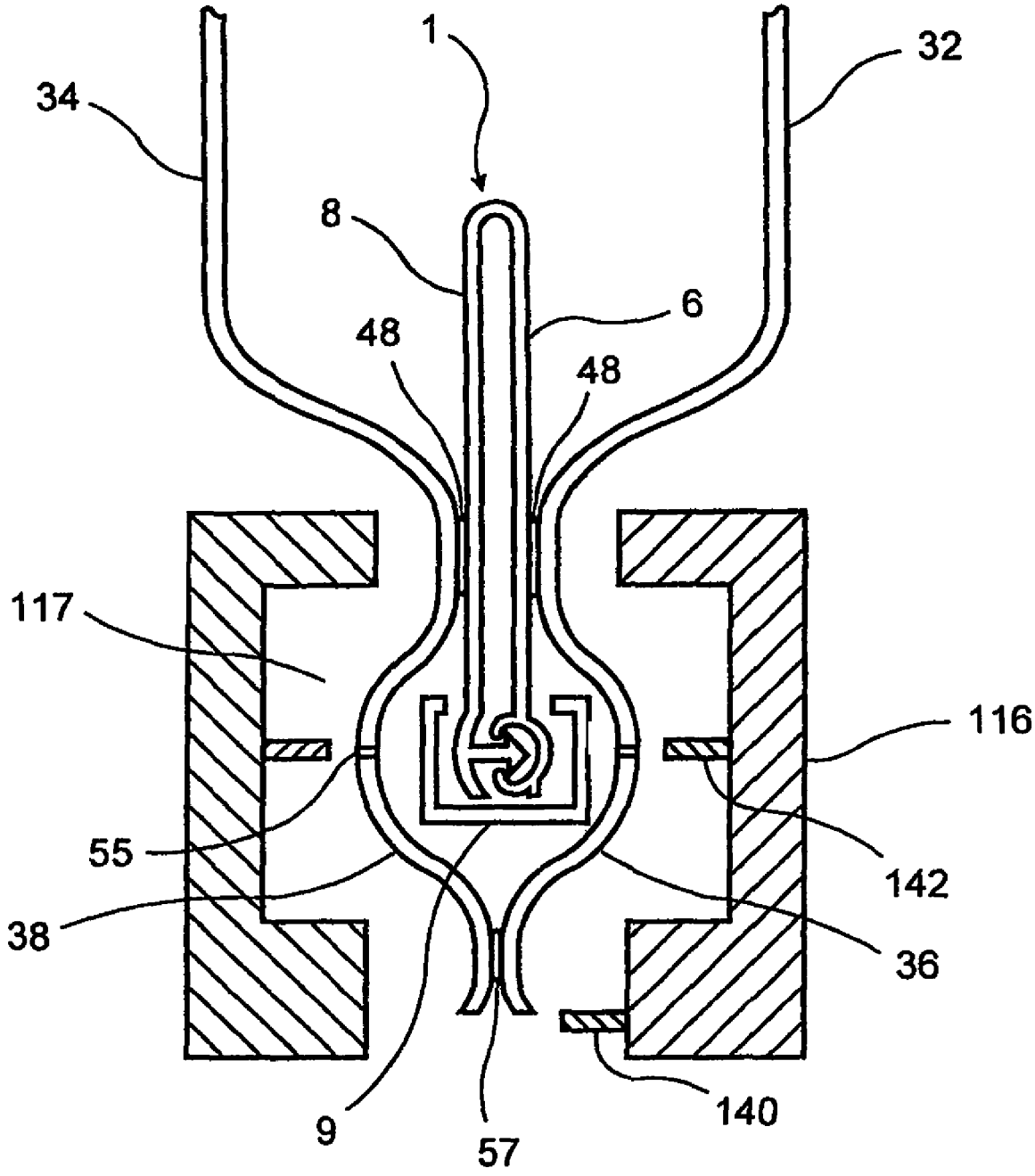
FIG. 27B is a cross-sectional view that is crosswise to the length of fastener shown in FIG. 1B taken along line 27B-27B of FIG. 26.
Figure 27C:
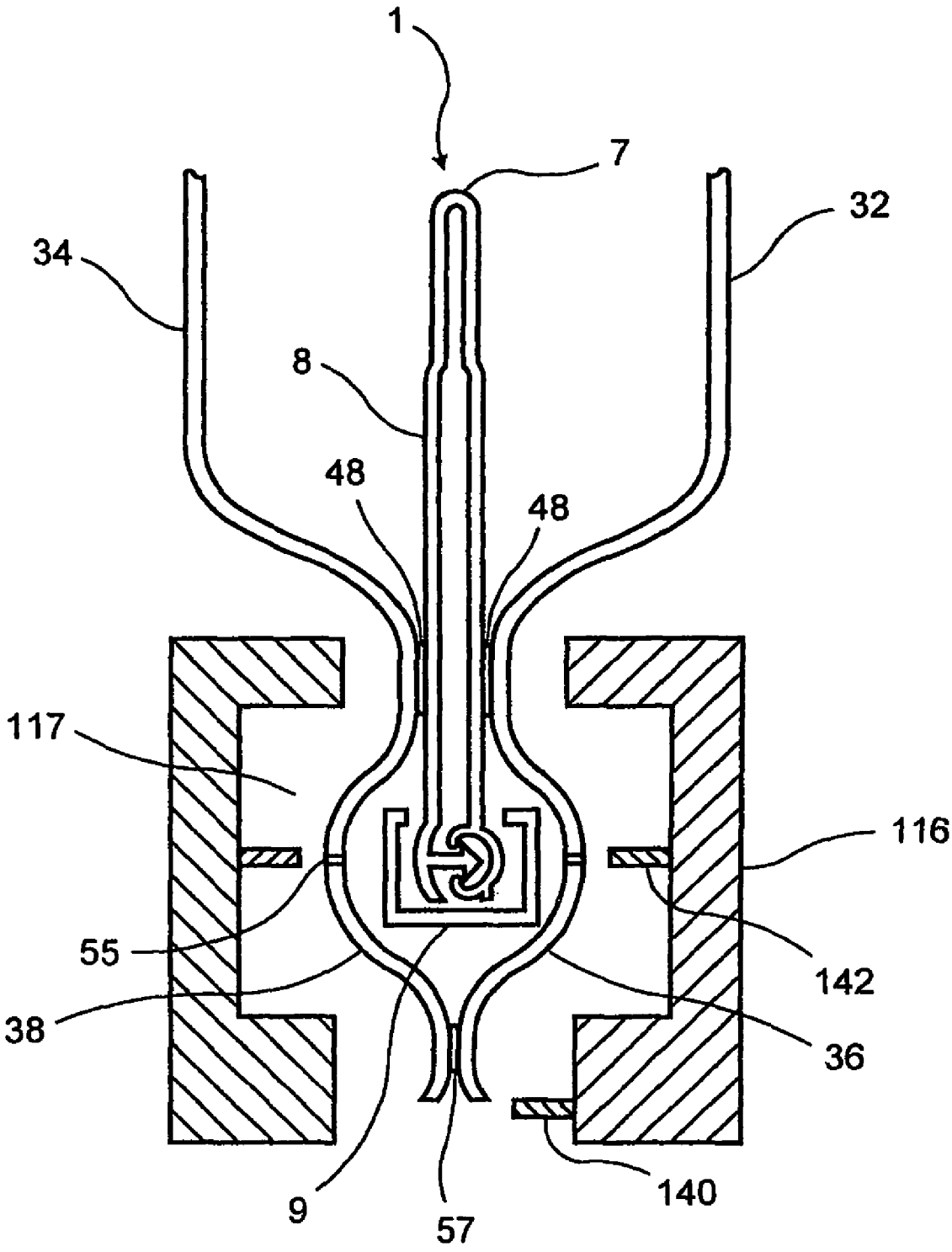
FIG. 27C is a cross-sectional view that is crosswise to the length of fastener, with the fastener being a combination of the fasteners shown in FIG. 1B and 11, the view taken along line 27C-27C of FIG. 26.
Figure 27D:
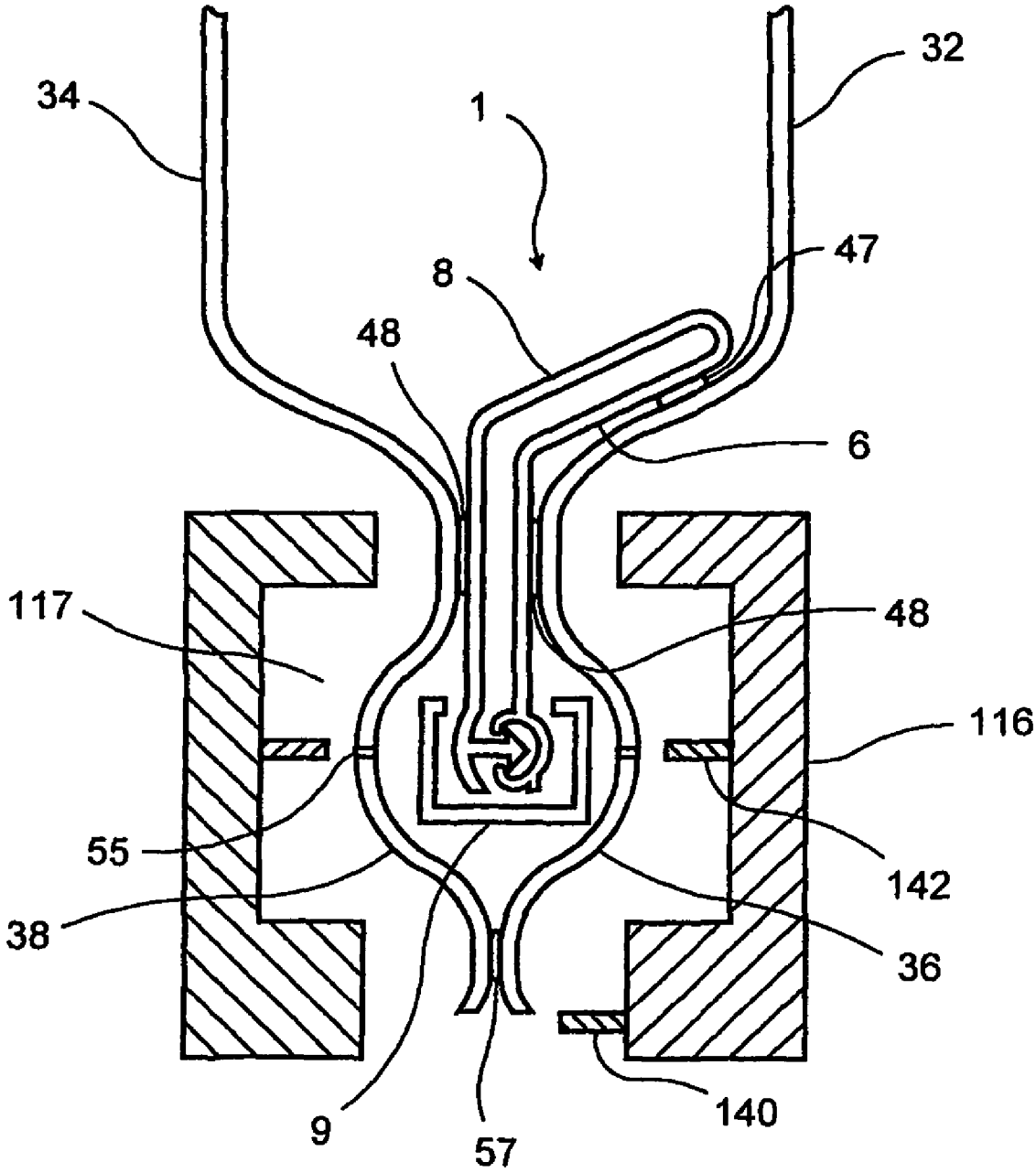
FIG. 27D is a cross-sectional view that is crosswise to the length of the fastener shown in FIGS. 1B, the view taken along line 27D-27D of FIG. 26.

Another variant of access to the slider 9 is to seal the tongues 36, 38 at a peel seal 57 to form film extensions to protect the fastener 1 and the attached slider 9, as shown in FIGS. 27-27D. Alternatively, a line of weakness 55 may be formed in the film extensions or the tongues 36, 38 by a cutting means 142. The perforations 55 or the peel seal 57 allow the user to tear either the perforations or the peel seal in order to access the fastener 1 and the slider 9.

The fastener 1 is already provided with the slider 9, and the longitudinal ends 3, 5 are possibly already welded together at spot welds 42, 44 which can act as end stops. The fastener 1 is therefore positioned and attached by the welding means 110 so that the slider 9 is on the longitudinal edge of the fastener 1, located toward the front with respect to the direction of movement D of the film 50.

When using a cutout to access the slider, at least one of the webs 6, 8 is welded to the film 50 on at least one edge of the first cutout 51 by the first transversal welding means 110. The film 50, thus provided with the fastener 1, is shaped in the form of a cylinder around the tube 130. A longitudinal weld 40 is formed by the longitudinal welding means 120. A second cutout 53 may be made downstream of the longitudinal welding means 120. The second cutout 53 would be made in the film 50 opposite to the first cutout 51, with the shape and dimension of this second cutout 53 being the same as those of the first cutout 51. A second cutout is made by a blade 135. If the blade 135 is located at the location of the tube 130, the blade 135 is curved. The fastener 1 is then welded by the second transversal welding means 116. The shape of second transversal welding means 116 is adapted to weld fasteners 1 that include the slider 9 by allowing passage of the slider by a groove 118 to the area of the weld.

Figure 4A:
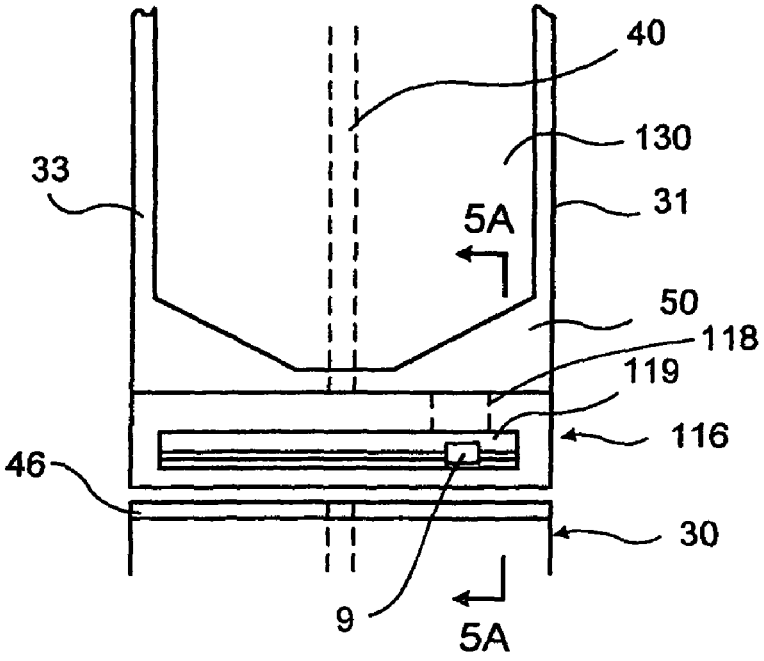
FIG. 4A is a top plan view of the second welding means of the variant of a bag forming machine, which is adapted for attaching fasteners that include a slider.
Figure 26:
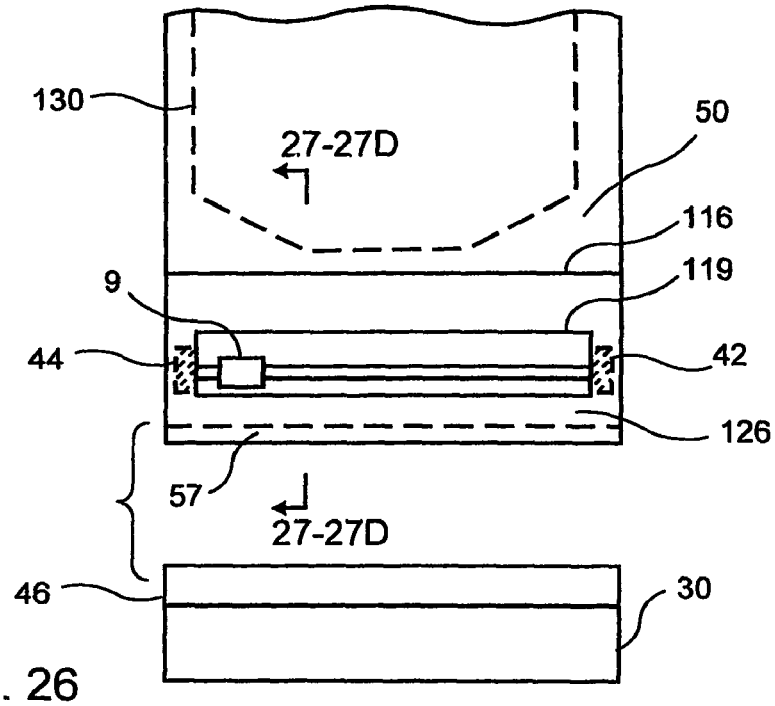
FIG. 26 is a top plan view of the second welding means of the variant of a bag forming machine adapted for attaching fasteners that include a slider and a film extension adjacent the fastener.

Examples of transversal welding means are illustrated in FIGS. 4A, 5A, 26 and 27-27D. As shown in FIGS. 4A and 26, the second transversal welding means 116 includes an opening 119. This opening 119 is parallel to profiles 10, 12 and is approximately equal in length to the profiles 10, 12. This opening is wide enough so that the welding bars of the second welding means 116 are not applied to the slider 9 during welding of the fastener 1 onto the film 50. The second welding means 116 therefore weld only webs 6, 8 of the fastener 1 to the film 50, along with the longitudinal ends 3, 5 of strips 2, 4. The second welding means 116 thus form transversal welds 46, 48 of the reclosable bag 30.

Figure 5A:
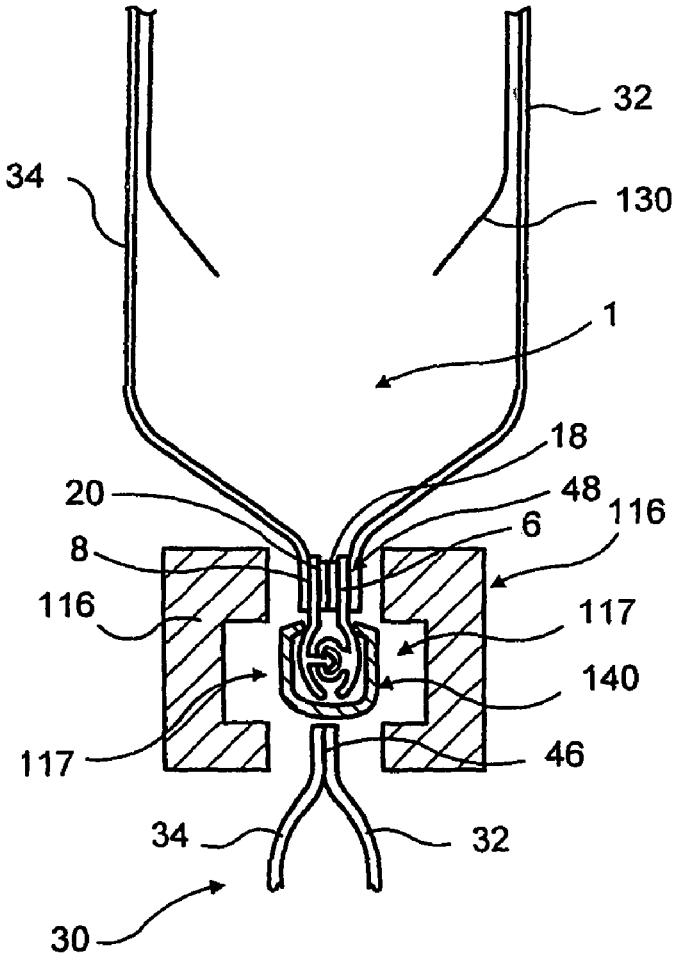
FIG. 5A is a cross-sectional view of a variant of the second welding means taken along line 5A-5A of the bag forming machine shown in FIG. 4A, with the second welding means adapted for attaching fasteners that include a slider.

As shown in FIGS. 5A and 27-27D, according to another variant of the second transversal welding means 116, these means have a U-shaped cross-section. This shape creates grooves 117 that form a cavity capable of receiving profiles 10, 12 and the slider 9 without deforming them when the welding bars of the second welding means 116 are pressed against each other to form the transversal welds 46, 48 and/or the peel seal 57.

Other methods can be envisaged for attaching a fastener 1 with the slider 9 to a film 50. In particular, it is possible to clear access to the slider 9 when making the cutouts 51, 53 in ways other than those described above.

As shown in FIG. 3A, the filling tube 130 may also be provided with a longitudinal groove or guiding ribs 132 capable of guiding the slider 9 toward the groove 118 of the second welding means 116 when the fastener 1 moves over filling tube. Additionally, a forming collar 134 may be provided with a trough leading to a groove 136 that guides the slider 9 into precise alignment with the longitudinal groove or the guiding ribs 132 of tube 130.

Figure 6:
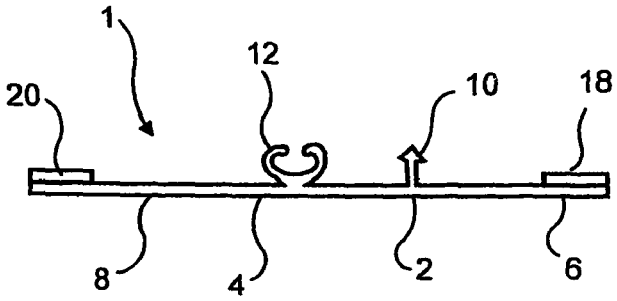
FIG. 6 is a cross-sectional view of an example of a fastener for embodying the process according to the invention.

FIG. 6 shows a fastener 1 which, in addition to webs 6, 8 and profiles 10, 12, has two strips 18, 20 that can form a peel seal. Peel seal strips 18, 20 extend over the entire length of the fastener 1 at the edges of the free ends of the webs 6, 8. Peel seal strips 18, 20 thus join the webs 6, 8 or parts of the webs on the side that will be located toward the outside of the reclosable bag 30 with respect to profiles 10, 12 after the reclosable bag 30 is fully formed.

Figure 7A:
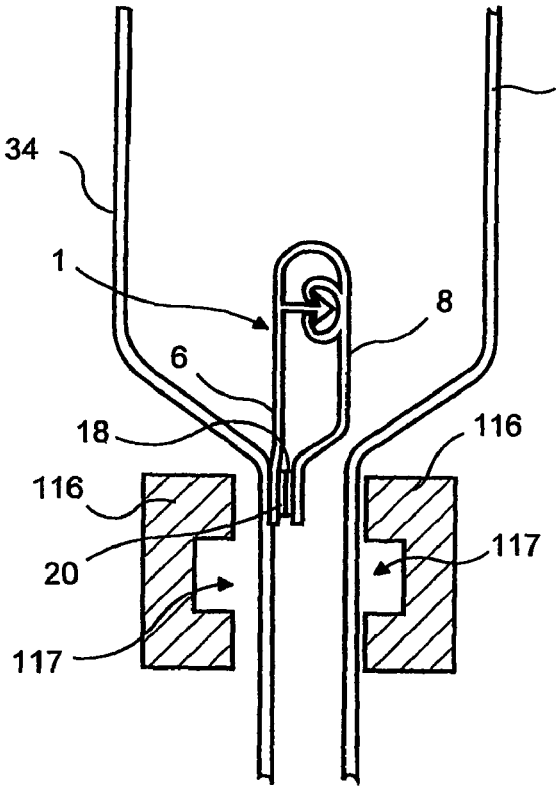
FIGS. 7A and 7B are cross-sectional views that are crosswise to the length of the fastener shown in FIG. 6, showing second welding means and means for cutting of the bag forming machine.
Figure 7B:
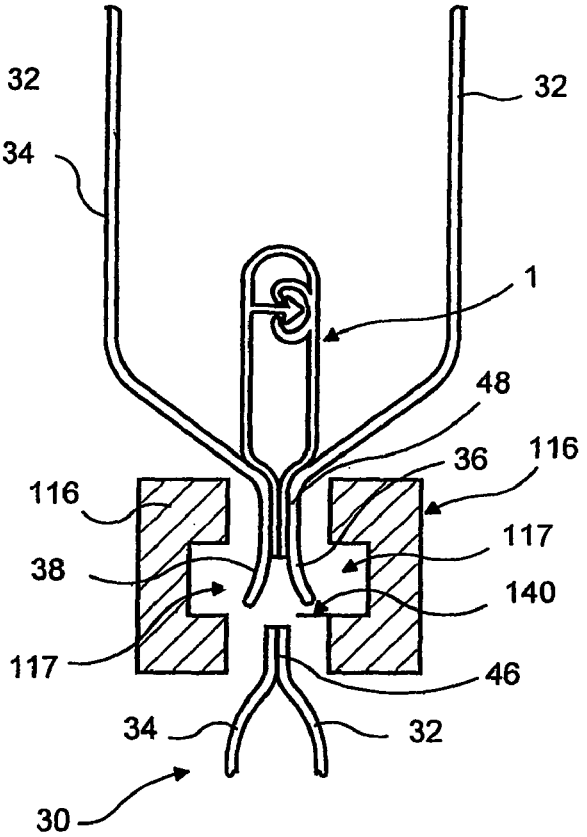

With regard to the second transversal welding means 116, FIG. 7A illustrates the positioning and welding of the fastener 1 to the walls 32, 34. The fastener 1 shown in FIG. 6 is shown in FIG. 7A in a closed configuration. The peel seal strips 18, 20 are prewelded to each other. The free end of web 6 of fastener 1 is attached to the wall 34 by the first welding means 110. It is possible, according to one variant of the process, that the peel seal strips 18, 20 are not prewelded and are then welded together and to the wall 34 during the step of attaching the web 6 to this wall by the first welding means 110. According to still another variant of the process, the entire set of walls 32, 34, webs 6, 8 and peel seal strips 18,20 are welded by the second transversal welding means 116. After the wall 32 has been brought close to the free edge of web 8, the process of attaching fastener 1 to the walls 32, 34 is completed at the same time the weld 46 is formed and at the same time the walls 32, 34 between the weld 46 of the reclosable bag 30 and the fastener 1 of the following reclosable bag (FIG. 7B) are cut. As described above, the groove 117 of the second transversal welding means 116 makes it possible to keep two areas of the walls 32, 34 unwelded in order to create tongues 36, 38 on the side of the profiles 10, 12 situated toward the outside of the reclosable bag 30.

Figure 8:
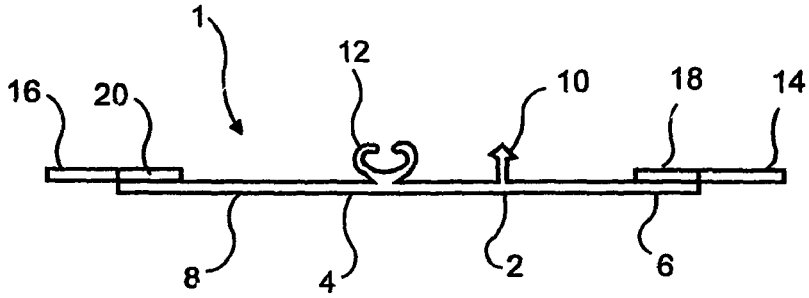
FIG. 8 is a cross-sectional view of another example of a fastener for embodying the process according to the invention.
Figure 9A:
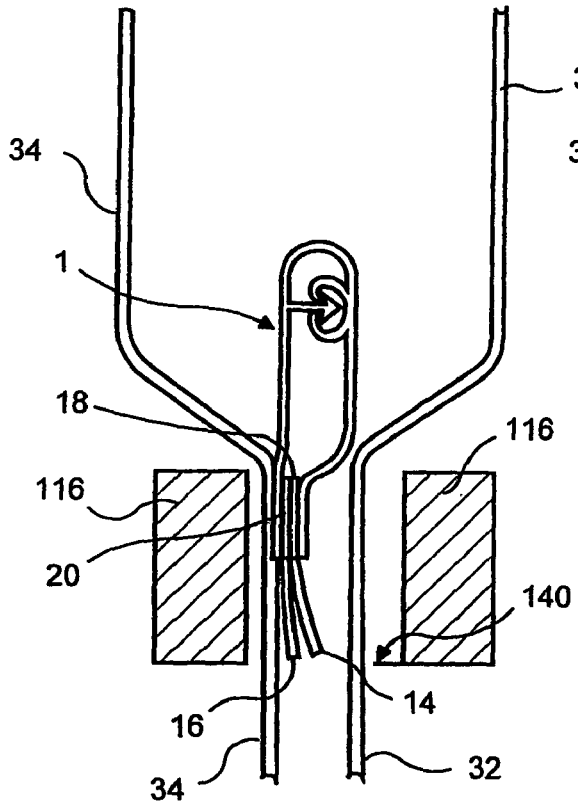
FIG. 9A is a cross-sectional view of the second welding means and of the cutting means that is crosswise to the length of the fastener shown in FIG. 8.
Figure 9B:
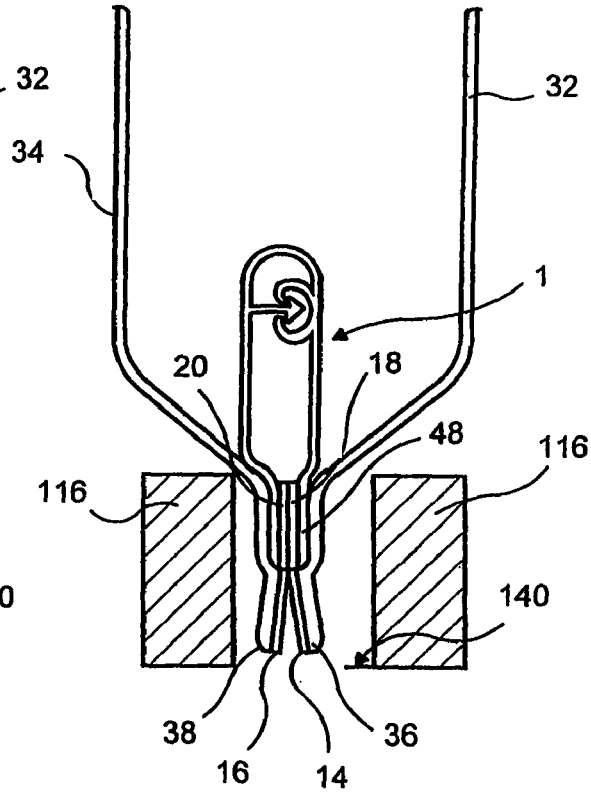
FIG. 9B is a view similar to FIG. 9A but after the welding operation is completed.

FIG. 8 shows a fastener 1 with two protective bands 14, 16. These protective bands 14, 16 extend over the entire length of the free longitudinal edges of the webs 6, 8. These protective bands 14, 16 are equipped with a barrier layer on the faces that are to be placed opposite each other, which prevents the protective bands 14, 16 from being welded together. As shown in FIG. 9A, the fastener 1 is welded to the walls 32, 34 by second transversal welding means 116 which do not have grooves 117. FIG. 9B shows that the walls 32, 34 are welded to the fastener 1, both at the location of the peel seal strips 18, 20 and at the location of the protective bands 14, 16. The protective bands 14, 16 are not welded together. Thus tongues 36, 38 are formed, which are capable of grasping the walls 32, 34 of the reclosable bag 30 in order to open the reclosable bag.

Figure 10:
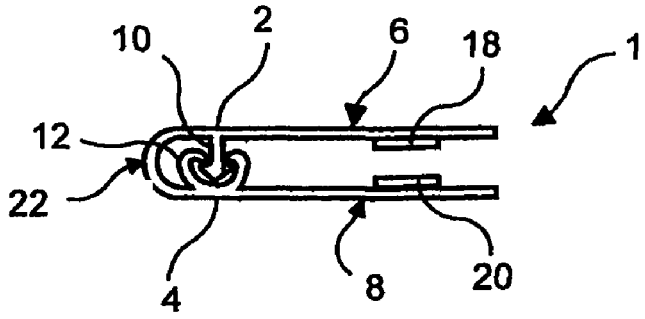
FIG. 10 is a cross-sectional view of another example of the fastener.

FIG. 10 is a cross-sectional view of a fastener 1, which is provided with a perforated line 22. When the fastener 1 is in an open position, the perforated line 22 is located between profiles 10 and 12 at approximately equal distances therefrom. This perforated line 22 extends over the entire length of the fastener 1 at the bottom of the U-shaped groove formed by the fastener 1 when it is in a closed position. After the reclosable bag 30 is opened, the fastener 1 is tom at the perforated line 22 by separating the peel seal strips 18, 20 and the profiles 10, 12.

Figure 11:
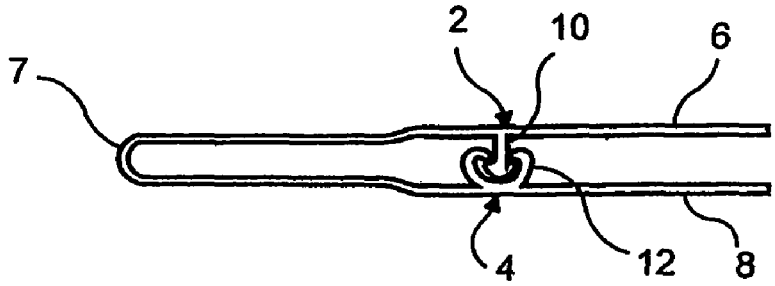
FIG. 11 is a cross-sectional view of still another example of the fastener.

FIG. 11 shows a variant of the fastener 1 shown in FIG. 10. According to this variant, a thin web 7 forms the U-shaped groove between the profiles 10, 12. Webs 6, 8 are shown extending on a side of the profiles 10, 12. However, if the webs 6, 8 do not extend in a manner similar to the U-shape shown in FIG. 1B, the profiles may be provided with a slider 9 similar to the arrangement shown in FIG. 27C.

Figure 12:
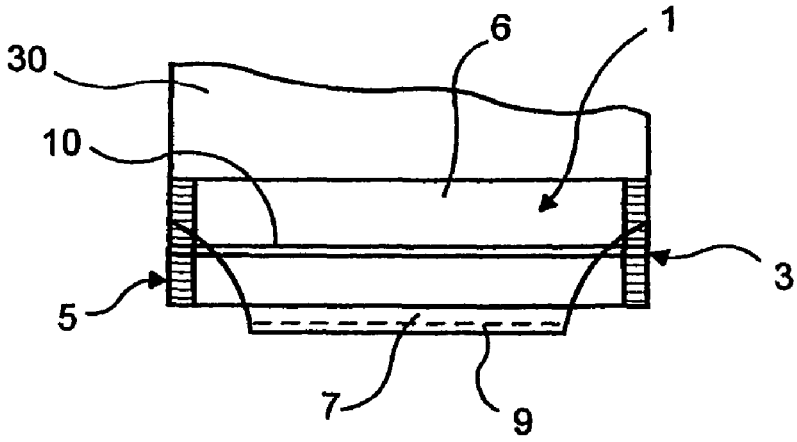
FIG. 12 is a top plan view of a reclosable bag provided with another example of the fastener.

This thin web 7 can easily be tom to open the reclosable bag 30, but it ensures that the fastener 1 is substantially watertight. If thin web 7 extends sufficiently, it can be turned inside out toward and between the webs 6, 8 when the contents of the reclosable bag 30 are emptied to protect profiles 10, 12 from the contents of the reclosable bag 30. Profiles 10, 12, thus protected, remain clean and able to work together effectively when reclosing the reclosable bag 30. Thin web 7 can also form a funnel or a pouring spout when it is pulled out from the reclosable bag 30 as shown, for example, in FIG. 12.

For instance, to form a pouring spout, the thin web 7 comprises two substantially trapezoidal-shaped elements placed one above the other and joined together at the two non-parallel edges of the trapezoids and on the shorter of the two parallel edges. The length of the longer of the two parallel edges of the trapezoid is equal to the dimension of the reclosable bag 30 transversely with respect to the direction of movement D of the film 50. These two non-parallel edges are welded between and with the longitudinal ends 3, 5 facing strips 2, 4.

Figure 13:
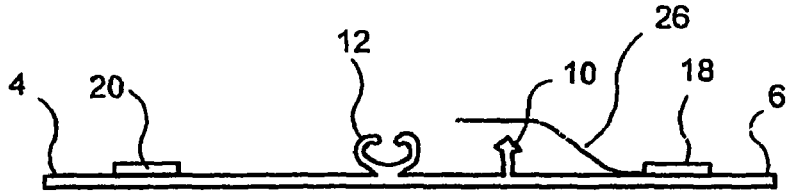
FIG. 13 is a cross-sectional view of another example of the fastener.

FIG. 13 shows a fastener 1 that, in addition to the peel seal strips 18, 20, includes a gasket membrane 26, the complementary profiles 10, 12 and the webs 6, 8. The gasket membrane 26 is welded over the entire length of the fastener 1, for example, close to the peel seal strip 18 between the peel seal strip 18 and the profile 10. The gasket membrane 26 extends sideways toward the other profile 12 and covers the profile 10.

Figure 14:
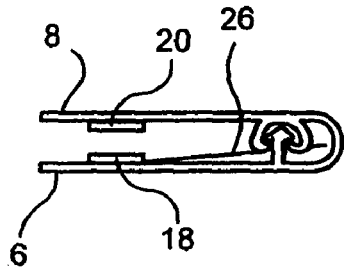
FIG. 14 is a cross-sectional view of the fastener shown in FIG. 13 in a closed configuration.

FIG. 14 shows the fastener 1 shown in FIG. 13 in the closed position. It is clearly shown that the sealing membrane 26 is engaged between profiles 10 and 12.

Figure 15:
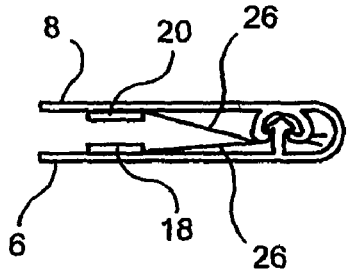
FIG. 15 is a cross-sectional view of another variant of the fastener.

FIG. 15 shows a fastener 1 similar to that illustrated in FIGS. 13 and 14, except that fastener 1 shown in FIG. 15 includes two gasket membranes 26 each welded to one of the webs 6, 8. It will be appreciated that the gasket membranes 26 of the foregoing embodiments may include a perforation located in close proximity to the point of attachment of the gasket membrane 26 to the webs 6, 8. Such a perforation facilitates removal of gasket membrane 26 from webs 6, 8.

FIGS. 16 through 20 show variants of fastener 1 that include at least one peel seal strip 18, 20, 21 and a perforated line 19.

Figure 16:
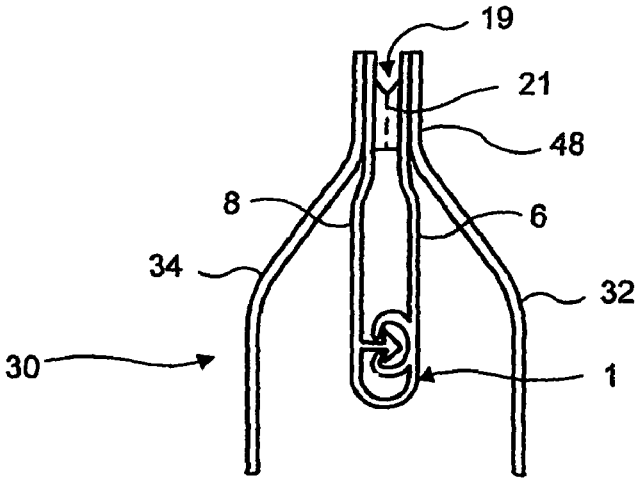
FIG. 16 is a cross-sectional view of the top of a reclosable bag that includes another valiant of the fastener.

FIG. 16 shows a fastener 1 which has a single peel seal strip 21 attached between webs 6, 8. The perforated line 19 is located on the edge of peel seal strip 21 located toward the outside of the reclosable bag 30 and between webs 6, 8. This perforated line 19 extends over the entire length of the fastener 1 and permits the peel seal strip 21 to be more easily pulled apart when the walls 32, 34 are separated to open the reclosable bag 30.

Figure 17:
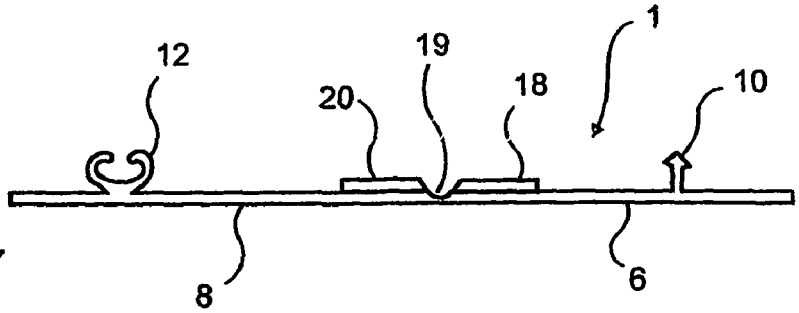
FIG. 17 is a cross-sectional view of another variant of the fastener.

FIG. 17 shows a fastener 1 in an open configuration. The perforated line 19 is located between the profiles 10, 12 at approximately the same distance from each of the profiles 10, 12 at the junction point of webs 6, 8. The peel seal strips 18, 20 run along this perforated line 19 over the entire length of the fastener 1.

Figure 18:
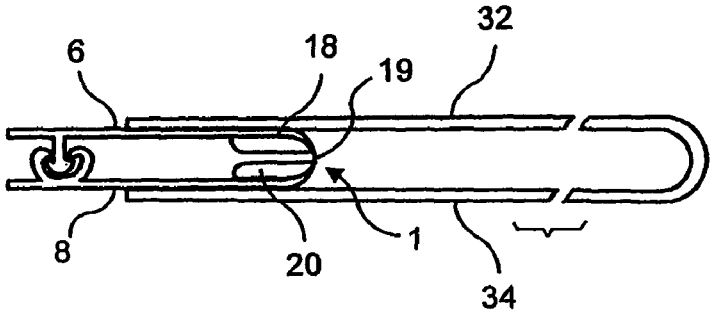
FIG. 18 is a cross-sectional view of the fastener shown in FIG. 17 in the closed configuration.
Figure 19:
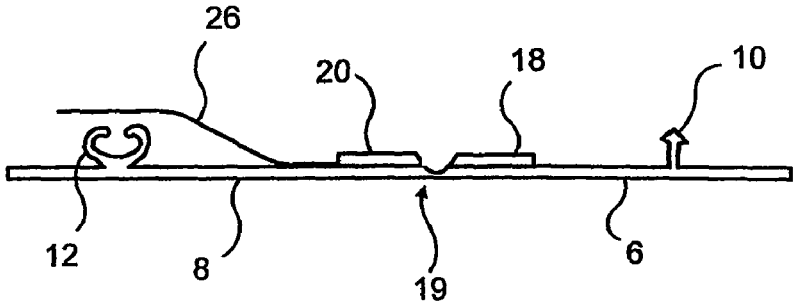
FIG. 19 is a cross-sectional view of another variant of the fastener.
Figure 20:
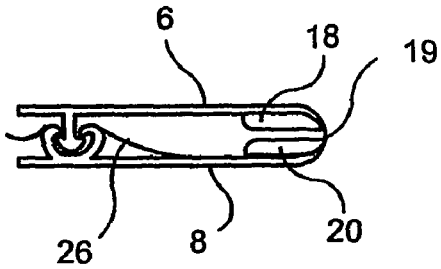
FIG. 20 is a cross-sectional view of the fastener shown in FIG. 19 in a closed configuration.

FIGS. 19 and 20 show a fastener 1, such as that shown in FIGS. 17 and 18, which also includes gasket membrane 26. This gasket membrane 26 is welded to the web 8 close to the peel seal strip 20 and extends sideways above profile 12.

FIG. 21 shows the fastener 1 attached to the film 50 (for example, before passing over the filling-tube 130 of an FFS machine). This fastener 1 comprises two webs 6, 8 connected together to form a U-shaped cross-section. The web 6 is attached to the film 50 by two weld points 47, 49 located on the web 6 on either side of the longitudinal direction of profile 10. These weld points 47, 49 can be made before the fastener 1 is folded back onto itself to engage profiles 10, 12. The weld points 47, 49 can extend more or less in the longitudinal direction of the strips 2, 4 or may extend over the entire length of the fastener 1. According to another variant, the fastener 1 can be held onto the film 50 by only one weld point 47. Preferably, in this case, weld point 47 is located downstream in relation to the movement D of the film 50 to prevent fastener 1 from turning upside down when passing over the filling tube 130.

Figure 22:
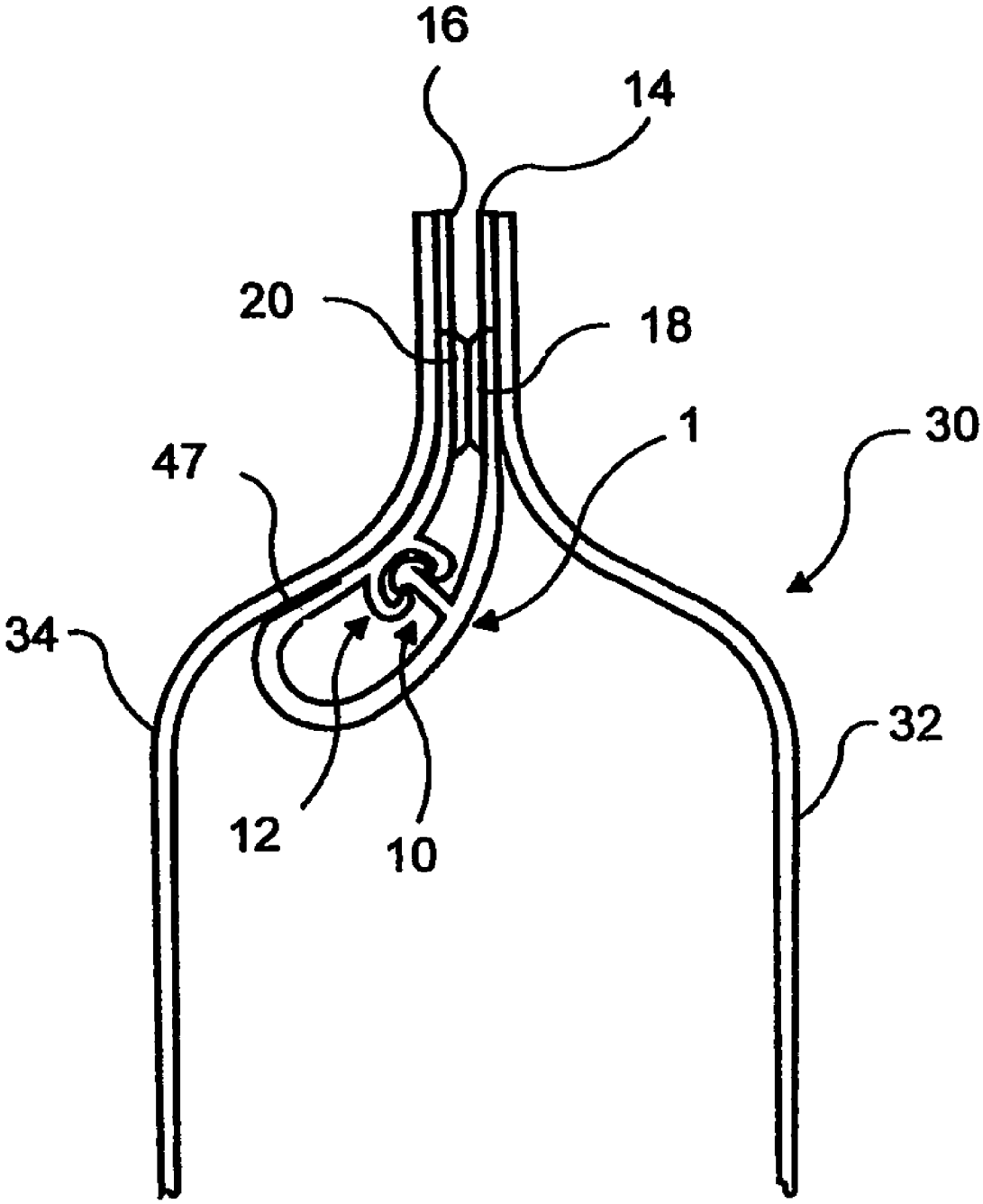
FIG. 22 is a cross-sectional view of the top of a reclosable bag with a fastener attached to the bag according to a variant of the process according to the invention.

Advantageously, one of these weld points 47, 49 is located on the side of the profiles 10, 12 which will be inside the reclosable bag 30 once it is formed. In this case, no equivalent facing weld point will be made on the second web 8. Thus, a hinged configuration is created that gives the reclosable bag 30 greater resistance to internal pressure as seen, for example, in FIG. 22. Using the method described in FIGS. 21 and 22 for the fastener 1 of FIG. 1B, the hinged configuration with attached slider 9 is shown in FIG. 27D.

Figure 23:
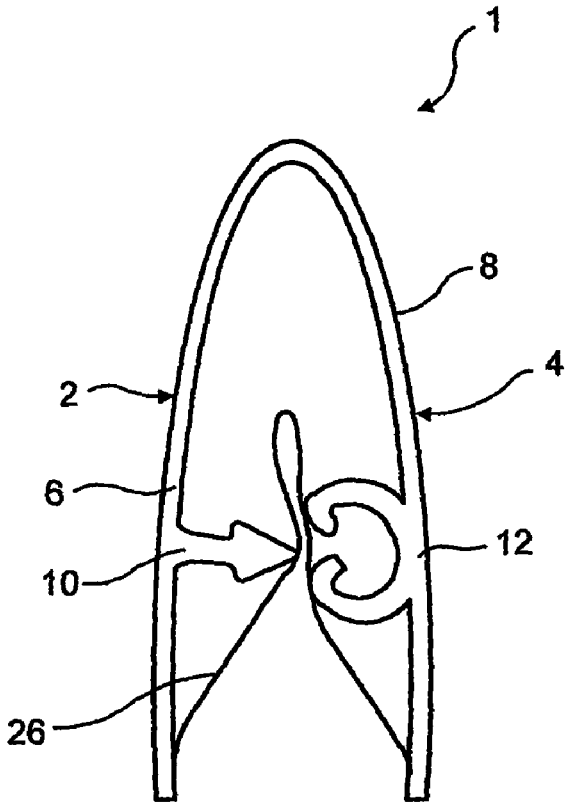
FIG. 23 is a cross-sectional view of still another variant of the fastener.

FIG. 23 illustrates an alternative embodiment of the fastener 1 shown in FIG. 15. Fastener 1 includes a single gasket membrane 26, which is welded on each end thereof to a respective one of webs 6, 8 on the interior side of the profiles 10, 12. Alternatively, gasket membrane 26 may be attached to the walls 32, 34 of the reclosable bag 30. The gasket membrane 26 is interposed between the profiles 10, 12 to form a fluid-tight seal between the interior and exterior of the reclosable bag 30. The profiles 10, 12 may be engaged or disengaged, and the gasket membrane 26 may be perforated near the point of attachment to either one or both of the webs 6, 8. Such a perforation facilitates removal of the gasket membrane 26 when the reclosable bag 30 is opened for the first time, thereby providing a tamper-evident barrier. Alternatively, the portion of the gasket membrane 26 located on the exterior side of the profiles 10, 12 may be perforated.

Figure 25:
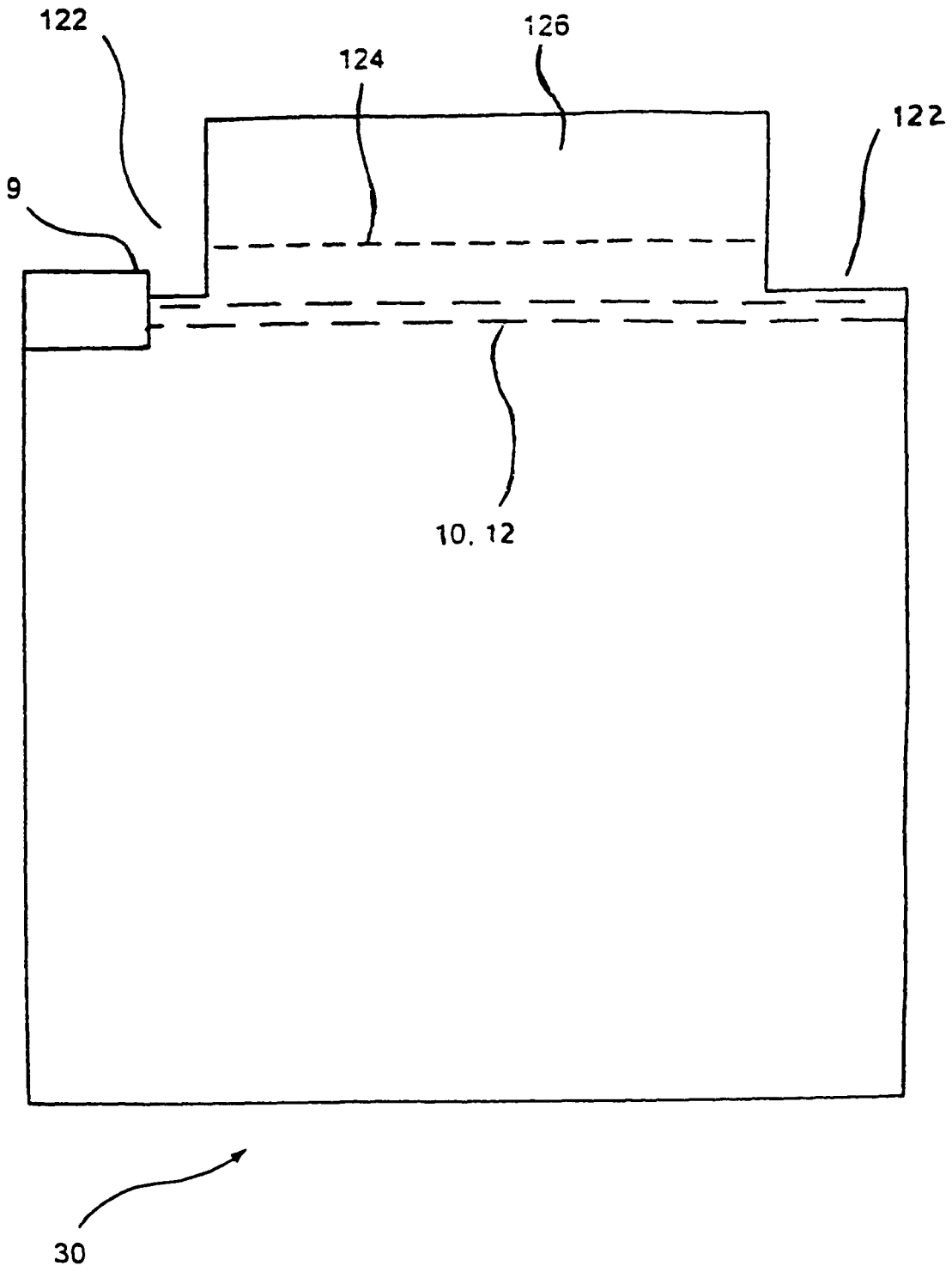
FIG. 25 is a top plan view of a tamper-evident reclosable bag.

FIG. 25 is a top plan view of another alternative for providing a tamper-evident slider-operated fastener, which requires replacing the cutouts 51, 53 with only side cuts 122 which extend above the longitudinal weld made by weld bars 110 for a short distance beyond profiles 10, 12. Accordingly, a film extension 126 beyond the profiles 10, 12 and a slider 9 are formed by sealing the tongues 36, 38. The film extension 126 comprising the tongues 36, 38 is formed by the cross-weld bars of the second welding means 116 as described above. Perforations 124 may also be made parallel and above the profiles The resulting open-ended loop thus formed above the slider-operated fastener must be tom off along the perforations before the slider can be used to open the bag 30. Alternatively, the film extension 126 may extend the length of the slider-operated fastener 1, as shown in FIG. 26. The film extension 126 of FIG. 26 may be torn open at the perforations 55 or at the peel seal 57 shown in FIGS. 27-27D.

It will be appreciated that the gasket membrane 26 of the several embodiments described above may, if of sufficient thickness, be provided for maintaining the profiles 10, 12 out of engagement when attaching the fastener 1 to walls 32, 34. It will be further appreciated that if the gasket membrane 26 is interposed between engaged or interlocked profiles 10, 12, and a pulling action is enacted on the walls 32, 34 of a formed reclosable bag 30, the gasket membrane 26 will act to separate the engaged or interlocked profiles 10, 12.

Figure 24:
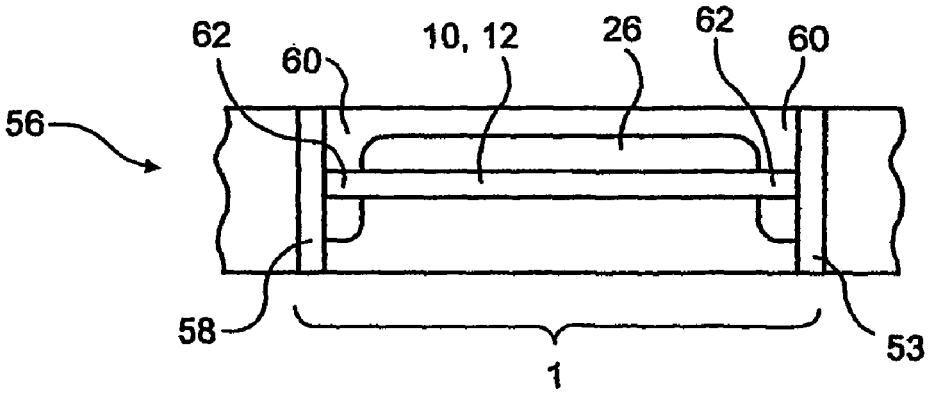
FIG. 24 is a top plan view of a tape of the fastener.

FIG. 24 illustrates a section of a tape 56 comprised of a series of fasteners 1, which are provided with gasket membranes 26 according to any of the embodiments described above. The tape 56 includes cross-seals 58, which define the extent of each fastener 1 and are spaced apart a distance approximately equal to the width of the reclosable bag 30 to be formed. The gasket membrane 26 includes a cutout portion 60 located in closed proximity to the cross-seals so that profiles 10, 12 may be positively engaged in the area of the cutout portion 60. Profiles 10, 12 may be engaged or disengaged over the remaining length of gasket membrane 26. The positive engagement area 62 of profiles 10, 12, which substantially corresponds to the cutout portion 60 of gasket membrane 26, ensures alignment of the profiles 10, 12 over the remaining length of the fastener 1 and the gasket membrane 26.

It is clear that the invention also extends to a machine for producing a film 50 to be used to form reclosable bags 30, including first welding means 110, which are transverse to the direction of movement of the film 50 and are capable of attaching a fastener 1 with webs 6, 8 to this film 50.

Thus, one obtains a film 50 for forming reclosable bags 30 with fasteners 1. These fasteners 1 may be attached to the film 50 by only a first web 6. Reclosable bags 30 may then be formed and completed from this film 50 provided with fasteners 1, either on a bag forming machine to be used and filled later or on an FFS machine.

The invention therefore also covers a forming, filling and sealing machine which includes first transversal welding means 110 upstream of a filling tube 130 and second transversal welding means 116 below the tube 130. The term "transversal" is to be understood herein to refer to the direction of movement of the film 50.

It will be appreciated that, although the gasket membrane 26 has beer. described hereinabove as being welded or attached to one or both of the webs 6, 8, the gasket membrane 26 may alternatively be welded or otherwise attached to one or both of the walls 32, 34 of the reclosable bag 30.

Thus, the several aforementioned objects and advantages of the invention are most effectively attained. Although preferred embodiments of the invention have been disclosed and described in detail herein, it should be understood that this invention is in no sense limited thereby and its scope is to be determined by that of the appended claims.

What is claimed is:

1. A method of manufacturing a film to form a reclosable bag, comprising the steps of:

moving the film; and attaching sequentially and crosswise with respect to the direction of movement of said film, a fastener comprising a first strip containing at least one reclosable profile interlocked with another reclosable profile that is complementary thereto and contained by a second strip, which will be subsequently attached to said film;

wherein each of said first and second strips of said fastener contains at least one web extending substantially laterally on one side of the profile contained thereon;

wherein said fastener further includes a first peel seal connecting the webs, said first peel seal disposed toward the inside of the bag with respect to the first and second profiles;

wherein said fastener further includes a slider for opening and closing said reclosable profiles;

wherein said fastener is attached to the film so that a film extension extends beyond each of said reclosable profiles and said slider, said method comprising the further step of sealing said film extensions together beyond said reclosable profiles and said slider; and wherein said film extensions are sealed together with a second peel seal.

* * * * *